US007401382B2

(12) United States Patent
Luo

(10) Patent No.: US 7,401,382 B2
(45) Date of Patent: Jul. 22, 2008

(54) HINGE ASSEMBLY FOR A FOLDABLE ELECTRONIC DEVICE

(75) Inventor: Pu Luo, Shenzhen (CN)

(73) Assignees: Hong Fu Jin Precision Industry (ShenZhen) Co., Ltd., Shenzhen, Guangdong Province (CN); Hong Hai Precision Industry Co., Ltd., Tu-Cheng, Taipei Hsien (TW)

( * ) Notice: Subject to any disclaimer, the term of this patent is extended or adjusted under 35 U.S.C. 154(b) by 254 days.

(21) Appl. No.: 11/261,252

(22) Filed: Oct. 28, 2005

(65) Prior Publication Data

US 2006/0143861 A1 Jul. 6, 2006

(30) Foreign Application Priority Data

Dec. 30, 2004 (CN) ..... 2004 2 0103603

(51) Int. Cl.
*E05F 1/08* (2006.01)

(52) U.S. Cl. ..... 16/303

(58) Field of Classification Search ..... 16/307, 16/308, 330, 303, 334, 336; 379/433.12, 379/433.13; 455/575.1, 575.3, 575.4, 550.1, 455/90.3; 361/680–683; 348/33.06, 373, 348/794

See application file for complete search history.

(56) References Cited

U.S. PATENT DOCUMENTS 6,633,643 B1 * 10/2003 Ona ..... 379/433.13
6,948,217 B2 * 9/2005 Higano et al. ..... 16/303
7,085,375 B2 * 8/2006 Katoh ..... 379/433.13
7,111,361 B2 * 9/2006 Li et al. ..... 16/284
2006/0010648 A1 * 1/2006 Luo ..... 16/330
2006/0070211 A1 * 4/2006 Luo ..... 16/303

FOREIGN PATENT DOCUMENTS

JP 2004204978 A * 7/2004

* cited by examiner

*Primary Examiner*—Chuck Y. Mah

(57) ABSTRACT

A hinge assembly (100) includes a shaft (10), a rotary cam (20), a follower cam (30), a positioning member (50), and an urging means (40). The shaft includes a securing portion (12) at one end thereof and has a slot (166) defined therealong. The rotary cam is substantially cylindrical and includes a cam surface (24). The rotary cam has a cam hole (22) extending therethrough. The cam hole receives the shaft therethrough. The follower cam includes a cylindrical portion (34) and two symmetrically protruding portions (36). The cylindrical portion includes a pinhole (346). The positioning member is received in the pinhole and the slot, thereby connecting the follower cam and shaft. The urging means biases against both the shaft and the rotary cam. The cam surface of the rotary cam is rotatably engaged with the protruding portion of the follower cam under a force generated by the urging means.

20 Claims, 5 Drawing Sheets

HINGE ASSEMBLY FOR A FOLDABLE ELECTRONIC DEVICE

BACKGROUND OF THE INVENTION

1. Field of the Invention

The present invention relates to hinge assemblies and, particularly, to a hinge assembly for foldable electronic devices, such as mobile telephones, electronic notebooks, and so on.

2. Discussion of the Related Art

With the development of the technologies of wireless communication and information processing, portable electronic devices such as mobile telephones and electronic notebooks are now in widespread use. These electronic devices enable consumers to enjoy the convenience of high technology services anytime and anywhere. Consumers particularly favor foldable electronic devices for their convenience.

Generally, foldable electronic devices have most of the electronics in one housing, called the body. The other housing, called the cover, normally contains fewer electronic components than the body. Some foldable electronic devices, in fact, have all the electronics in the body, with the cover containing no electronics. Various types of hinge assemblies are used to join a body and a cover of a foldable electronic device, so that the cover can be selectably folded and unfolded relative to the body. Manufacturers are constantly seeking to reduce the volume, size, and/or weight of portable foldable electronic devices.

Thus, it is desirable that the hinge assembly coupling the main housing with the cover is modularized and miniaturized. A modularized hinge assembly has moving parts such as a cam member, a cam follower, and a spring, all held together in a unified structure. The structure is easily and quickly attached to the main housing and the cover during mass production. A miniaturized hinge assembly has as few parts as possible, with the parts being as small as practicable.

One kind of a hinge assembly is described in P.R. China Patent No. 98109390.6, issued on Aug. 28, 2002. The hinge assembly includes a shaft, a cam, a sliding cam, a spring, and an E-clip. The shaft has a securing portion at one end thereof, for engaging with a main body of a mobile phone. The cam defines a groove, for engaging with a flip cover of the mobile phone. The spring, the sliding cam, and the cam are located around the shaft, in that order. The sliding cam and the cam engage with each other, and the sliding cam can move along the shaft. The E-clip resists the cam, thereby preventing the cam from falling from the shaft.

Although the above-described hinge assembly is suitable for some foldable electronic devices, the cam, engaging with the flip cover, and the securing portion of the shaft, engaging with the main body, are respectively disposed at two ends of the hinge assembly, which makes the hinge assembly endure a relatively large torsion force. This need for such a substantial torsion force wastes energy, in the form of friction, and that friction causes abrasion of the spring and the shaft. That abrasion may eventually lead to premature malfunction or failure of the hinge assembly.

What is needed, therefore, is a hinge assembly which can have a relatively long working lifetime and which is energy efficient (i.e., easily opened) and convenient to use.

SUMMARY OF THE INVENTION

In a first preferred embodiment, a hinge assembly is provided for joining a flip cover to a main body of a foldable electronic device. The hinge assembly includes a shaft, a rotary cam, a follower cam, a positioning member, and an urging means (e.g., a spring member). The shaft has a securing portion formed at one end thereof, and has a longitudinal hole/slot defined therewithin. The rotary cam is essentially in the shape of a cylinder and defines a cam surface. The rotary cam has a cam hole extending therethrough. The cam hole receives the shaft therethrough. The follower cam includes a cylindrical portion and two symmetrically protruding portions extending axially from the cylindrical portion. The cylindrical portion has a pinhole therein. The positioning member is received both in the pinhole and slot, thereby securely connecting the follower cam with the shaft. A first end of the urging means abuts the shaft, and an opposite second end of the urging means biases against the rotary cam. The cam surface of the rotary cam is rotatably and movably engaged with the protruding portion of the follower cam under the force of the urging means.

A main advantage of the hinge assembly is that the rotary cam, engaging with the flip cover, and the securing portion, engaging with the main body, are respectively disposed at the middle and at one end of the hinge assembly The relative proximity of these two elements can reduce the torsion force imposed on the hinge assembly. Accordingly, when the hinge assembly is assembled in the mobile phone, the energy/force required in opening/closing the flip cover is reduced. Furthermore, the working lifetime of the hinge assembly is prolonged as the friction forces associated therewith are likewise reduced.

Other advantages and novel features will become more apparent from the following detailed description when taken in conjunction with the accompanying drawings.

BRIEF DESCRIPTION OF THE DRAWINGS

Many aspects of the hinge assembly can be better understood with reference to the following drawings. The components in the drawings are not necessarily to scale, the emphasis instead being placed upon clearly illustrating the principles of the present hinge assembly. Moreover, in the drawings, like reference numerals designate corresponding parts throughout the several views.

DETAILED DESCRIPTION OF PREFERRED EMBODIMENTS

Figure 1:
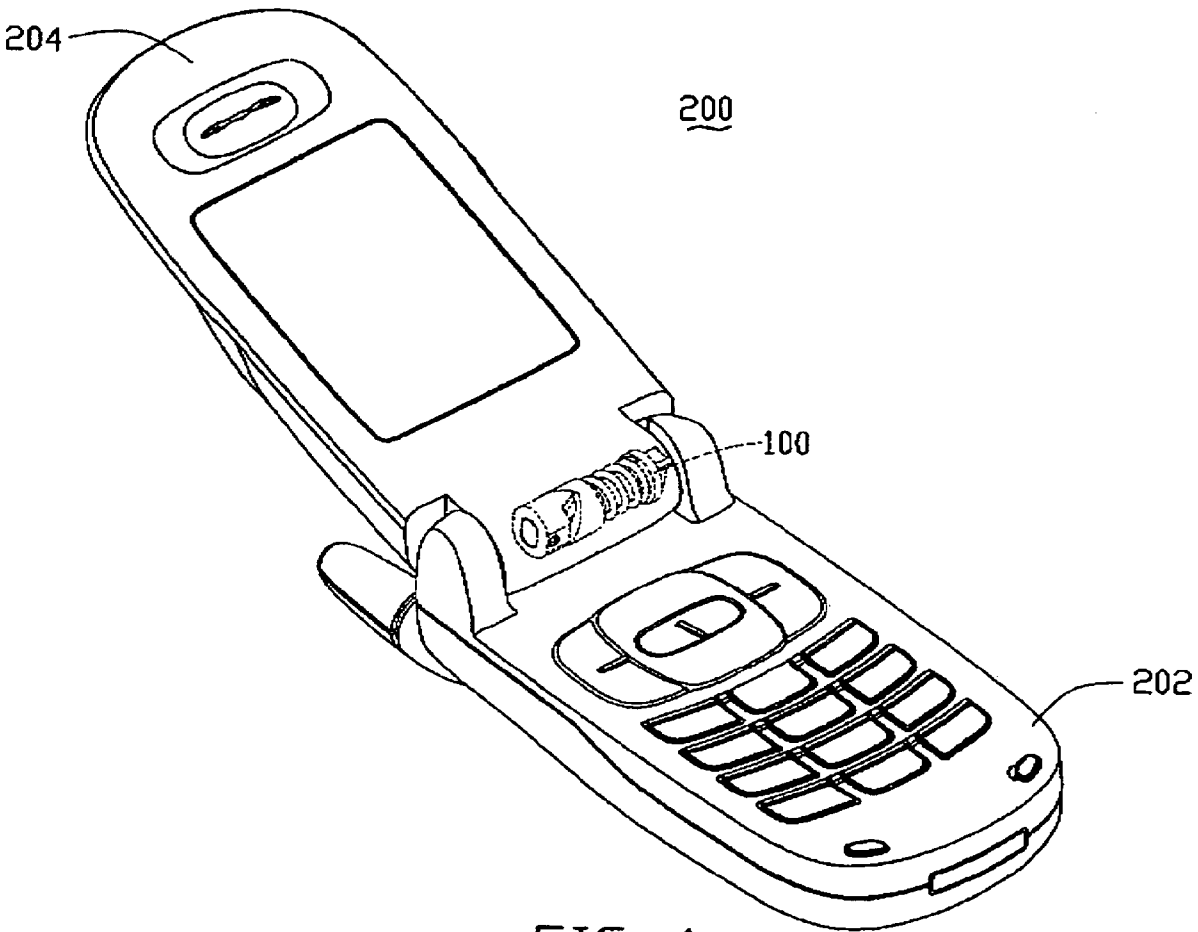
FIG. 1 is an isometric view of a flip-type mobile phone including a flip cover, a main body, and a hinge assembly, according to a preferred embodiment, the hinge assembly being shown with dashed lines.

Referring now to the drawings, FIG. 1 shows a flip-type mobile phone 200, which includes a hinge assembly 100, according to a preferred embodiment. The mobile phone 200 has a main body 202 and a flip cover 204. The main body 202 and the flip cover 204 are pivotally connected to each other via the hinge assembly 100. It should be noted that the hinge assembly 100 may also, for example, be used to interconnect components like a main body and a flip cover of any of various different kinds of foldable electronic devices, other than the mobile phone 200.

Figure 2:
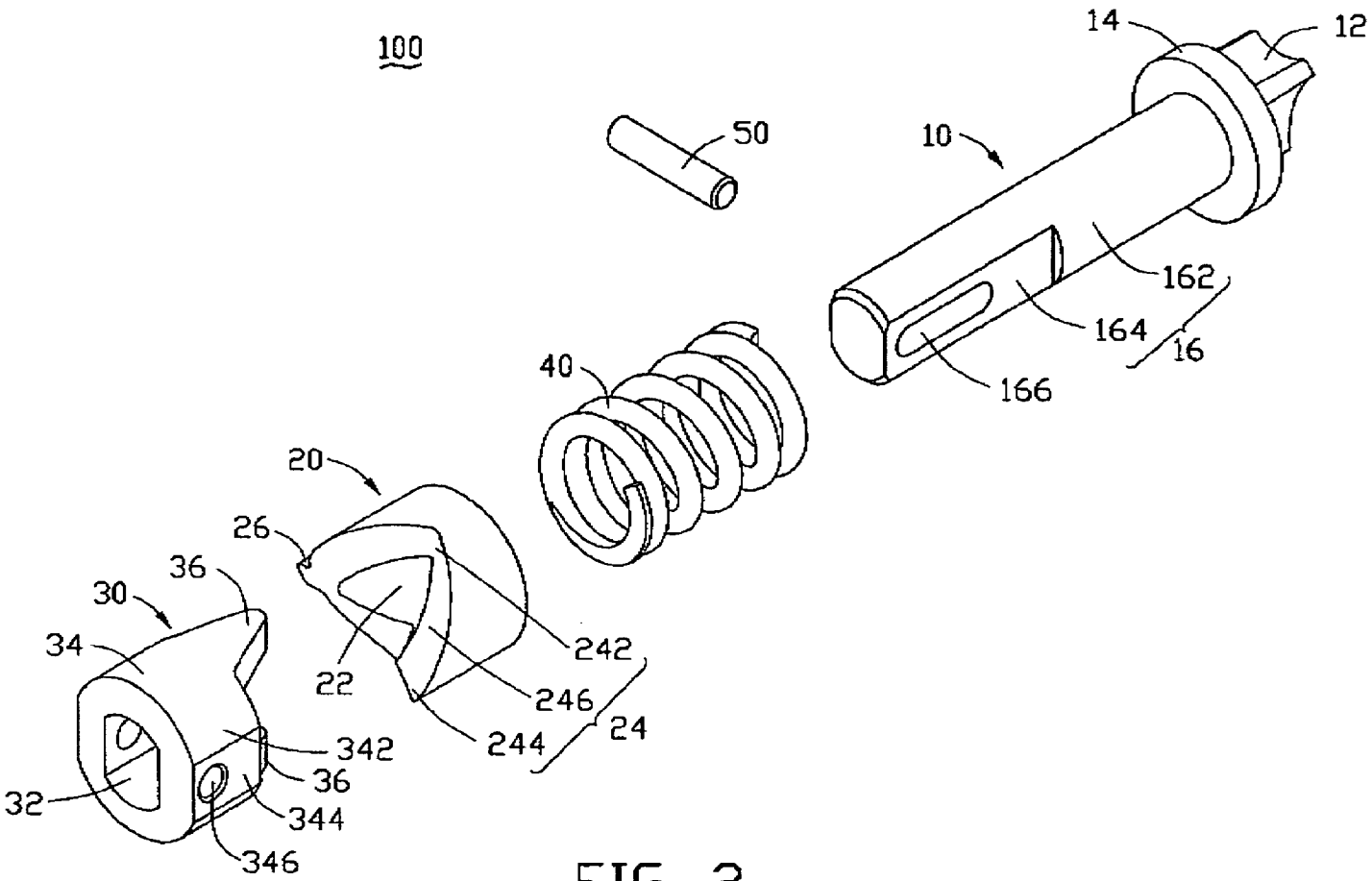
FIG. 2 is an enlarged, exploded, isometric view of the hinge assembly of FIG. 1.
Figure 3:
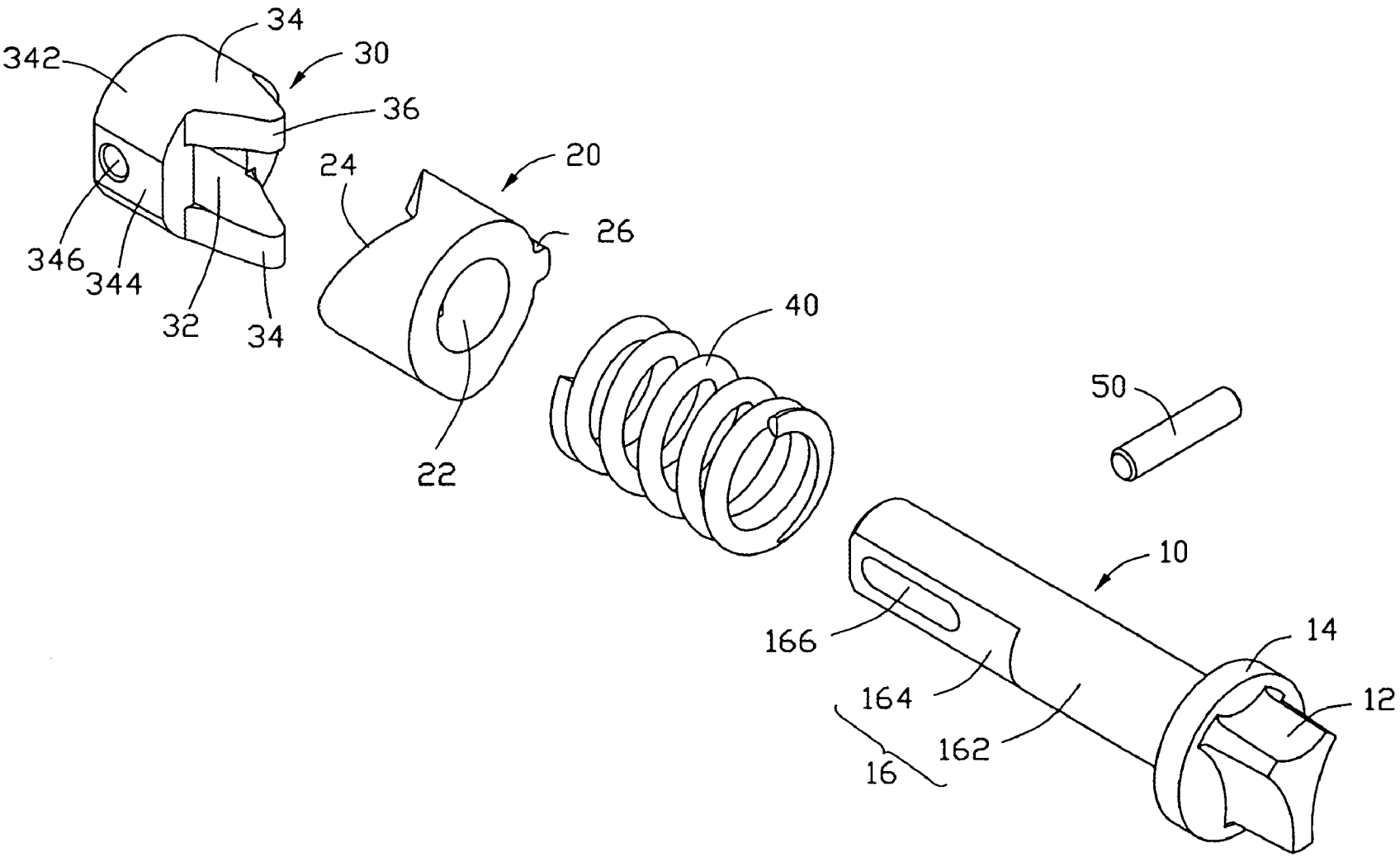
FIG. 3 is similar to FIG. 2, but viewed from another aspect.

Referring now to FIGS. 2-3, the hinge assembly 100 includes a shaft 10, a rotary cam 20, a follower cam 30, a spring 40 functioning as an urging means, and a pin 50 functioning as a positioning member. The shaft 10 extends through the spring 40, the follower cam 30, and the rotary cam 20 in that order, thereby integrating the hinge assembly 100 into a complete unit.

The shaft 10 includes, in sequence, a securing portion 12 formed at one end thereof, a flange portion 14 adjacent the securing portion 12, and a shaft portion 16 adjacent the flange portion 14. The diameter of the shaft portion 16 is smaller that tat of the flange portion 14. The shaft portion 16 includes a circular shaft portion 162 and a deformed shaft portion 164. The circular shaft portion 162 adjoins the flange portion 14. The deformed shaft portion 164 has a longitudinal hole (i.e., a slot) 166 defined therein. The slot 166 is oriented longitudinally, relative to the length of the shaft portion 16, and is adjacent a distal end thereof. The width of the longitudinally-oriented slot 166 corresponds to the diameter of the pin 50. A length of the slot 166 along an axis of the shaft 10 is larger than the width of the slot 166 along a direction perpendicular to the axis of the shaft 10.

The rotary cam 20 is a generally cylindrical body and defines a central cam hole 22. The rotary cam 20 has a cam surface 24 formed at one end thereof. The cam surface 24 includes two valleys 242, two peaks 244, and four inclined planes 246 disposed between the valleys 242 and the peaks 244. Preferably, the valleys 242 are located 180 degrees opposite from each other, and the peaks 244 are located 180 degrees opposite from each other. The cam 20 has a protrusion 26 formed on outer peripheral wall thereof, the protrusion 26 being oriented parallel to a central axis of the cam 20. The protrusion 26 is configured for engaging with the flip cover 204 of the mobile phone 200.

The follower cam 30 is a generally cylindrical body and has a central hole 32 therein. The follower cam 30 includes a cylindrical portion 34 and two symmetrical protruding portions 36 extending axially of the cylindrical portion 34. The cylindrical portion 34 includes two opposite arcuate faces 342 and two opposite planar faces 344. A pair of opposite pinholes 346 are defined through the arcuate faces 342 of the cylindrical portion 34, each such pinhole 346 being configured for receiving the pin 50. The pinholes 346 are aligned with each other. The protruding portions 36 can engage with the cam surface 24 of the rotary cam 20. The shape of the central hole 32 corresponds to the shape of the deformed shaft portion 164 of the shaft 10, thereby facilitating engagement with the deformed shaft portion 164.

The spring 40 is advantageously helical and is preferably metallic. Furthermore, the spring 40 has an inner diameter larger than a diameter of the circular portion 162 of the shaft 10. Thus, the spring 40 can be located around the shaft portion 16 of the shaft 10. A first end of the spring 40 resists the flange portion 14 of the shaft 10, and an opposite second end of the spring 40 biases against the cam 20.

The pin 50 is cylindrical and has a diameter corresponding both to a common diameter of the pinholes 346 of the follower cam 30 and to the width of the slot 166 of the shaft 10. In a preferred embodiment, the pin 50 has a diameter slightly larger than the diameter of the pinholes 346 and the slot 166, so that the pin 50 can be inserted into and interferingly fixed with the shaft 10 and the follower cam 30. The pin 50 is slidable in the slot 166 of the shaft 10 along a direction of the axis of the shaft 10.

Figure 4:
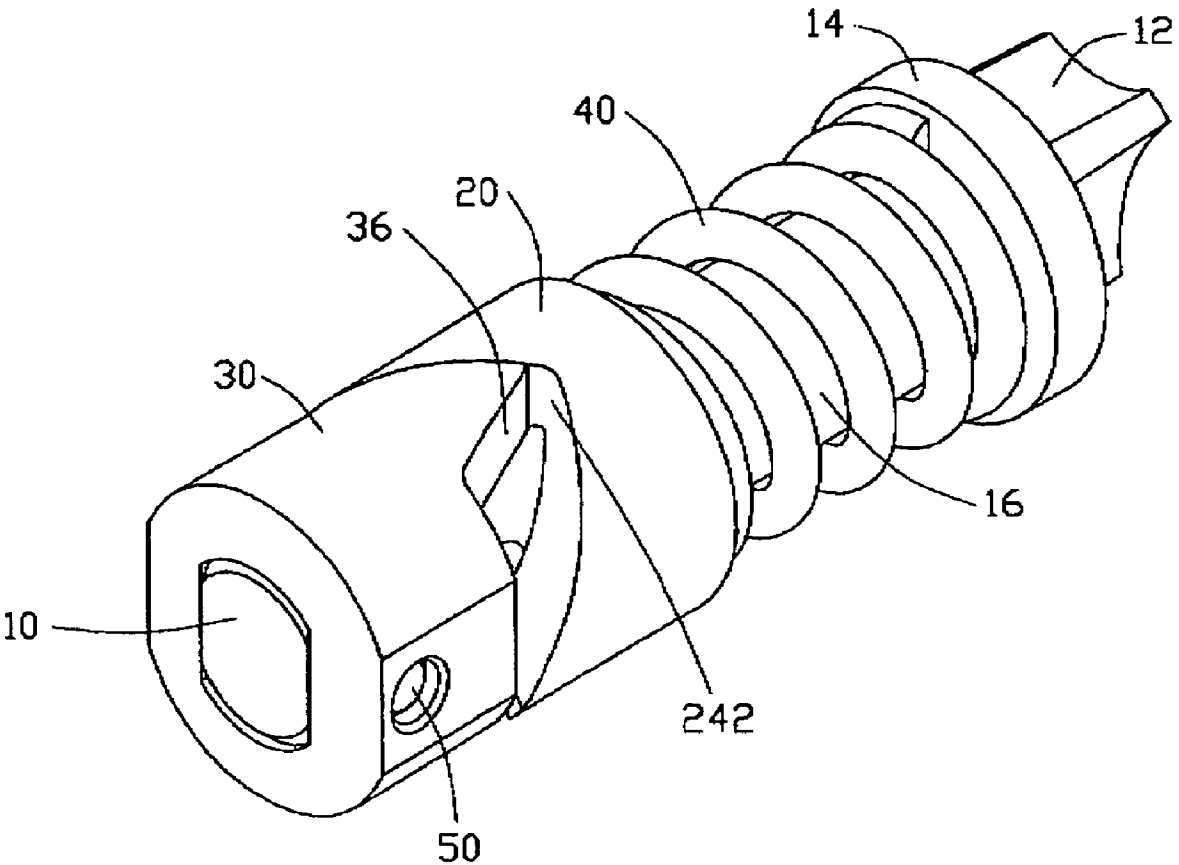
FIG. 4 is an enlarged, assembled view of the hinge assembly of FIG. 2.

In the assembly of the hinge assembly 100, referring to FIG. 4, firstly, the shaft 10 is passed through the spring 40, the cam hole 22 of the rotary cam 20, and the center hole 32 of the follower cam 30, in that order, with the pinholes 346 of the follower cam 30 aligning with the slot 166 of the shaft 10. Secondly, the pin 50 is inserted into and securely engaged in the pinholes 346 of the follower cam 30 and in the slot 166 of the shaft 10, so that the follower cam 30 is securely connected with the shaft 10. Preferably, the pin 50 is interferingly engaged in the pinholes 346, with the two ends of the pin 50 being substantially lower than the planar faces 344 of the follower cam 30. More preferably, the pin 50 is also interferingly engaged in the slot 166. The flange portion 14 of the shaft 10 resists the spring 40, thereby preventing the spring 40 from falling off from the end of the shaft 10. The cam surface 24 of the cam 20 always contacts the protruding portions 36 no matter what rotational position the cam 20 is in, because of the urging force of the spring 40. The hinge assembly 100 is thus completely assembled, as shown in FIG. 4.

Referring to FIGS. 1 and 4, in use, the protrusion 26 is engaged (i.e., operatively located/fixed) in a cavity (not shown) of the flip cover 204 of the mobile phone 200, and the securing portion 12 of the shaft 10 is engaged in the main body 202 of the mobile phone 200. When the flip cover 204 of the mobile phone 200 is in a fully closed position or a fully open position, the protruding portions 36 of the follower cam 30 are located in the valleys 242 of the cam 20 and operatively bias against the valleys 242.

Figure 5:
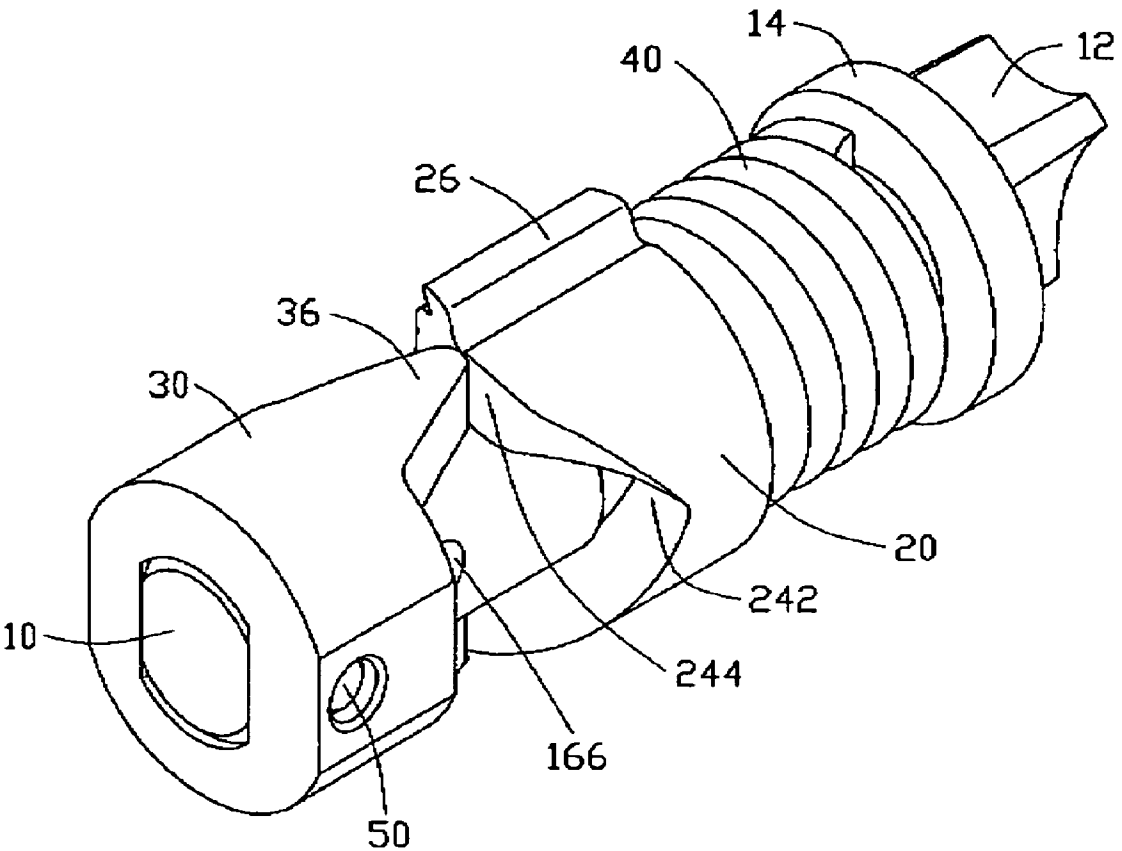
FIG. 5 is an assembled view of the hinge assembly of FIG. 2, showing the hinge assembly in a first position corresponding to a closed position of a foldable electronic device.

Referring also to FIG. 5, when the flip cover 204 of the mobile phone 200 is rotated between an open position and a closed position (or vice versa), the cam 20 rotates along with the flip cover 204. Concurrently, the shaft 10 remains fixed in the main body 202 of the mobile phone 200, and the follower cam 30 is securely connected with shaft 10. As a result, the protruding portions 36 ride along the inclined planes 246 of the cam surface 24 from the valleys 242 to the peaks 244 (see FIG. 5), with the cam 20 moving toward the flange portion 14 of the shaft 10 and compressing the spring 40.

Once the protruding portions 36 pass over the peaks 244, the spring 40 decompresses and drives the cam 20 back toward the follower cam 30, with the protruding portions 36 riding along the inclined planes 246 from the peaks 244 to the valleys 242. The flip cover 204 is thus rotated automatically to the fully closed position (or fully open position) under the decompression force of the spring 40. Accordingly, the flip cover 204 is moved 180 degrees relative to the main body 202, with the protruding portions 36 once again mating in the valleys 242. In this way, the flip cover 204 is closed (or opened). Preferably, the structures of the flip cover 204 and the main body 202 are adapted to control the degree of rotation of the hinge assembly 100, such that the protruding portions 36 can be held in one or more particular locations between the valleys 242 and the peaks 244. It is further considered to be within the scope of the present hinge assembly that the assembly could instead be configured to facilitate movement through some maximum angle less than 180 degrees, thereby allowing the flip cover 204 to be angled relative to the main body 202 in the full, open position. This change in maximum rotation angle could be achieved by reconfiguring cam surface 24 (e.g., by effectively making valleys 242 be off-diameter of the rotary cam 20 by a certain amount).

During the process of assembly of the hinge assembly 100, the spring 40 always has a predetermined compressing force. The follower cam 30 has a tendency to move along the shaft 10 toward the slot 166. Because the slot 166 of the shaft 10 extends along the shaft 10 a predetermined distance, it is only required that the pinholes 346 of the follower cam 30 align with any portion of the slot 166 of the shaft 10. Once aligned in this manner, the pin 50 can be inserted into the pinholes 346 and the slot 166. Thus, the follower cam 30 is secured on the shaft 10 via the pin 50, making it convenient and easy to put together the hinge assembly 100.

A main advantage of the hinge assembly 100 is that the rotary cam 20, connected to the flip cover 204 of the mobile phone 200, and the securing portion 12, attached to the main body 202 of the mobile phone 200, are respectively disposed at the middle and one end of the hinge assembly 100. This proximity of the rotary cam 20 and the securing portion 12 can reduce the torsion force imposed on the hinge assembly 100. Accordingly, when the hinge assembly 100 is assembled in the mobile phone 200, the energy required in opening the flip cover 204 of the mobile phone 200 is reduced. Furthermore, the working lifetime of the hinge assembly 100 is prolonged.

In further alternative embodiments, the spring 40 can be made of a nonmetallic material such as plastic. Further, the spring 40 can instead be another kind of elastic element or urging means known in the art, such as a resilient cylinder. Additionally, there can be more than one protrusion 26. It is also to be understood that the hinge assembly 100 may prove useful in other environments besides in foldable electronic devices.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A hinge assembly, comprising:

a shaft comprising a securing portion formed at one end thereof, the shaft further having a slot formed therethrough, the slot being oriented along an axis of the shaft;

a rotary cam substantially in the shape of a cylinder, the rotary cam comprising a cam surface, the rotary cam further having a cam hole extending therethrough, the cam hole receiving the shaft therein;

a follower cam comprising a cylindrical portion and two symmetrically protruding portions, the protruding portions each extending axially from the cylindrical portion, the cylindrical portion having at least one pinhole formed therein;

a positioning member received in the pinhole and the slot, the positioning member being configured for securely connecting the follower cam with the shaft, the positioning member being slidable in the slot of the shaft along directions of the axis of the shaft; and an urging means having a first end and an opposite second end, the first end of the urging means abutting the shaft, the opposite second end of the urging means biasing the rotary cam, the cam surface of the rotary cam being rotatably and movably engaged with the protruding portions of the follower cam under a force of the urging means.

2. The hinge assembly as claimed in claim 1, wherein the urging means is a helical spring located around the shaft.

3. The hinge assembly as claimed in claim 1, wherein the rotary cam has at least one engagement member formed thereon.

4. The hinge assembly as claimed in claim 3, wherein each engagement member is a protrusion disposed on an outer peripheral wall of the rotary cam.

5. The hinge assembly as claimed in claim 1, wherein the shaft further comprises a flange portion formed adjacent the securing portion, the first end of the urging means abutting the flange portion.

6. The hinge assembly as claimed in claim 1, wherein the shaft further comprises a shaft portion, the shaft portion including a circular shaft portion and a deformed shaft portion.

7. The hinge assembly as claimed in claim 6, wherein the deformed shaft portion has two opposite planar faces, the slot being defined in the planar faces.

8. The hinge assembly as claimed in claim 1, wherein the positioning member is a pin.

9. The hinge assembly as claimed in claim 1, wherein the cam surface has a pair of opposite valleys and a pair of opposite peaks.

10. A foldable electronic device, comprising:

a main body;

a flip cover; and a hinge assembly configured for joining the flip cover to the main body, the hinge assembly including:

a shaft comprising a securing portion formed at one end thereof, the shaft further having a slot formed therethrough, the slot being oriented along an axis of the shaft, the securing portion engaging with the main body;

a rotary cam substantially in the shape of a cylinder, the rotary cam comprising a cam surface and an engagement mechanism, the rotary cam having a cam hole extending therethrough, the cam hole receiving the shaft therein, the engagement mechanism being operatively connected with the flip cover;

a follower cam comprising a cylindrical portion and two symmetrically protruding portions, each protruding portion extending from the cylindrical portion axially, the cylindrical portion having at least one pinhole defined therein;

a positioning member received both in the pinhole and the slot, the positioning member thereby securely connecting the follower cam with the shaft, the positioning member being slidable in the slot of the shaft along directions of the axis of the shaft; and an urging means having a first end and an opposite second end, the first end of the urging means abutting the shaft, the opposite second end of the urging means biasing the rotary cam, the cam surface of the rotary cam being rotatably and movably engaged with the protruding portions of the follower cam under a force of the urging means.

11. The foldable electronic device as claimed in claim 10, wherein the urging means is a helical spring located around the shaft.

12. The foldable electronic device as claimed in claim 10, wherein the engagement mechanism is a protrusion disposed on an outer peripheral wall of the rotary cam.

13. The foldable electronic device as claimed in claim 10, wherein the shaft further comprises a flange portion formed adjacent the securing portion, the first end of the urging means abutting the flange portion.

14. The foldable electronic device as claimed in claim 10, wherein the shaft further comprises a shaft portion, the shaft portion includes a circular portion and a deformed shaft portion.

15. The foldable electronic device as claimed in claim 14, wherein the deformed shaft portion has two opposite planar faces, the slot being defined in the planar faces.

16. The foldable electronic device as claimed in claim 10, wherein the positioning member is a pin.

17. The foldable electronic device as claimed in claim 10, wherein the cam surface has a pair of opposite valleys and a pair of opposite peaks.

18. The foldable electronic device as claimed in claim 10, wherein the foldable electronic device is a mobile phone.

19. The hinge assembly as claimed in claim 1, wherein a length of the slot along the axis of the shaft is larger than a width of the slot along a direction perpendicular to the axis of the shaft.

20. The foldable electronic device as claimed in claim 10, wherein a length of the slot along the axis of the shaft is larger than a width of the slot along a direction perpendicular to the axis of the shaft.

* * * * *